US009702567B2

(12) United States Patent
Owen

(10) Patent No.: US 9,702,567 B2
(45) Date of Patent: Jul. 11, 2017

(54) HEATER SYSTEM

(71) Applicant: William D. Owen, Kahoka, MO (US)

(72) Inventor: William D. Owen, Kahoka, MO (US)

( * ) Notice: Subject to any disclaimer, the term of this patent is extended or adjusted under 35 U.S.C. 154(b) by 0 days.

(21) Appl. No.: 14/542,234

(22) Filed: Nov. 14, 2014

(65) Prior Publication Data

US 2016/0138810 A1 May 19, 2016

(51) Int. Cl.

| | |
|---|---|
| ***F24D 3/02*** | (2006.01) |
| ***F24B 1/08*** | (2006.01) |
| ***F24B 13/04*** | (2006.01) |
| ***F24D 19/00*** | (2006.01) |
| *F24B 9/00* | (2006.01) |

(52) U.S. Cl.

CPC ..... *F24D 3/02* (2013.01); *F24B 1/08* (2013.01); *F24B 13/04* (2013.01); *F24D 19/00* (2013.01); *F24B 9/00* (2013.01); *F24B 9/006* (2013.01); *F24D 2200/067* (2013.01)

(58) Field of Classification Search

CPC ..... F24B 1/08; F24B 9/00

USPC ..... 237/59; 110/196, 233, 234, 293, 255, 110/258, 108; 126/107, 10, 68, 7, 223, 126/501

See application file for complete search history.

(56) References Cited

U.S. PATENT DOCUMENTS 752,681 A * 2/1904 Hyatt et al. ..... 110/293
807,090 A * 12/1905 Rahner ..... 110/293
902,714 A * 11/1908 Cope ..... 110/293
1,594,127 A * 7/1926 Slater et al. ..... 110/234
1,925,967 A * 9/1933 Olson ..... 164/76.1
1,932,566 A * 10/1933 Wunderlich ..... B21F 33/04 140/92.4
2,822,934 A 5/1954 Bartelt
2,843,106 A 7/1958 Tipper
2,876,762 A 3/1959 Tipper
(Continued)

FOREIGN PATENT DOCUMENTS

DE 202006006456 7/2006
GB 844969 8/1960
(Continued)

OTHER PUBLICATIONS

Yabu, JP9-56248A English machine translation, Mar. 4, 1997.*

*Primary Examiner* — Alissa Tompkins
*Assistant Examiner* — Phillip E Decker
(74) *Attorney, Agent, or Firm* — David E. Crawford; Crawford IP Law

(57) ABSTRACT

A heater having a combustion chamber. The heater includes a hopper and a chute extending from an outlet of the hopper to the combustion chamber. The heater includes a chute extending from the hopper to the combustion chamber, a screw extending through the chute into the hopper, and a drive connected to the screw for turning the screw in a direction in which the flight would, but for downward forces, lift the fuel. The heater has a vane rotatably attached to the screw that rotates downward along the screw in absence of upward forces counteracting gravity. The vane is cambered to produce upward forces when turning with the screw beneath an upper surface of the fuel. The vane is biased toward the upper surface of the fuel to level the upper surface of the fuel and prevent the fuel from rat holing and arching.

14 Claims, 3 Drawing Sheets

(56) References Cited

U.S. PATENT DOCUMENTS 3,240,400 A * 3/1966 Smith ..... B65B 1/10 222/185.1
3,248,019 A 4/1966 Kohler
3,308,994 A * 3/1967 Rohn ..... B65D 88/64 222/227
3,379,323 A 4/1968 Knutsen
3,611,594 A 10/1971 Blackman
3,785,304 A * 1/1974 Stookey ..... 110/234
4,122,801 A * 10/1978 Burns ..... 122/20 B
4,289,079 A 9/1981 Swistun
4,366,802 A * 1/1983 Goodine ..... 110/108
4,371,375 A 2/1983 Dennis, Jr. et al.
4,377,116 A 3/1983 Satake
4,474,117 A 10/1984 Marollaud
4,541,410 A * 9/1985 Jatana ..... 122/18.3
4,672,899 A * 6/1987 Kainer ..... 110/234
4,836,115 A 6/1989 MacArthur
4,894,274 A 1/1990 Graham et al.
5,042,539 A 8/1991 McGregor
5,265,773 A * 11/1993 Harada ..... B01F 7/00208 222/241
5,601,362 A 2/1997 Schuler
5,983,885 A * 11/1999 Jarvi ..... 110/101 CA
6,048,374 A * 4/2000 Green ..... 110/235
6,390,664 B1 5/2002 Kniele et al.
6,668,583 B2 * 12/2003 O'Brien ..... F16G 11/00 24/128
7,614,463 B1 * 11/2009 Hunziker ..... E21B 12/06 15/256.53
7,793,669 B2 * 9/2010 Farano ..... A47L 15/4463 134/93
8,640,633 B2 * 2/2014 Raley ..... F23B 50/12 110/222
8,844,471 B2 * 9/2014 Glanville et al. ..... 237/59
2004/0226495 A1 * 11/2004 Gagnon ..... 110/234
2007/0137538 A1 * 6/2007 Sterr ..... F23B 30/00 110/341
2008/0156237 A1 * 7/2008 Leihgeber ..... 110/258
2008/0276924 A1 * 11/2008 McMillan ..... 126/77
2010/0058960 A1 * 3/2010 Raley et al. ..... 110/293
2014/0005656 A1 * 1/2014 Mucilli ..... A61B 18/18 606/33
2014/0238282 A1 * 8/2014 Zhu ..... F24B 1/181 110/241
2015/0020790 A1 * 1/2015 Zhu ..... F23K 3/14 126/68
2015/0159879 A1 * 6/2015 Zhu ..... F23K 3/14 126/73

FOREIGN PATENT DOCUMENTS

GB EP 1710372 A2 * 10/2006 ..... B21F 7/00
JP 0956248 A * 3/1997
JP 2002224838 8/2002
JP 2004276956 10/2004
JP 200515041 1/2005
JP 2005182822 7/2005
JP 2012220154 A * 11/2012

* cited by examiner

HEATER SYSTEM

BACKGROUND

The present invention generally relates to a heater system, and more particularly, to a heater system having improved fuel delivery and heat extraction systems.

Conventional heaters burn fuel to produce thermal energy or heat, which is usually used for heating air and/or water. Various fuels are burned, but biofuels have become increasingly popular. Solid biofuels include organic materials such as sawdust, wood chips, and other plant materials (e.g., corn husks). These biofuels are desirable because they are byproducts of industry. For example, sawdust and wood chips are readily available at sawmills and furniture manufacturers and provide a low-cost heating source. Plant materials are readily available at farms and nurseries and also may be used for heating. Other solid biofuels such as dried animal waste may also be available as fuel to provide heat.

Conventional heaters often include a stoker or fuel delivery system for delivering the selected fuel to a combustion chamber or combustor where the fuel is burned to produce heat. Fuel delivery mechanisms include conveyor belts, chutes, and augers. The burning fuel is supplied with air to provide oxygen needed to burn the fuel. In some cases, a blower forces air past the burning fuel to feed the fire. The resulting gases are vented through a vent pipe or exhaust vent extending from the combustor. Ash and residual solid materials are also removed, e.g., by gravity, to clear the combustor for further biofuel delivery.

Although these systems provide inexpensive heat, there are issues which limit their effectiveness. For example, the fuel delivery mechanisms may not be dependable. The fuels may stop flowing (e.g., due to rat holing or arching as will be explained below), thereby starving the fire. In other instances, the fuel delivery mechanism continues to feed fuel to the combustor after the fire goes out. Before the fire can be relit, the excess fuel must frequently be removed from the combustor.

Many heaters incorporate heat exchangers to capture heat from the system for heating air, water, or other fluids. Some prior heaters have heat exchangers that cause inefficient fuel burning, which results in excessive smoking and soot build up. In some heaters, heat fluctuates significantly with changing conditions, providing an undependable heat source and operating temperatures outside desirable working ranges. Thus, there remains a need for heater improvements that capture heat for warming air, water, and other fluids.

SUMMARY

In one aspect, the present invention includes a heater having a combustion chamber for burning fuel. The combustion chamber has an interior defined by side walls and a top. The combustion chamber includes an air inlet at a bottom of the combustion chamber and an exhaust vent at the top of the combustion chamber. In addition, the heater includes a hopper mounted above the combustion chamber. The hopper is sized for holding a preselected amount of fuel and has an outlet at a lower end. The heater also has a chute extending from the outlet of the hopper to the combustion chamber. Still further, the heater includes a chute extending from the outlet of the hopper to the combustion chamber, a screw having a helical flight extending through the chute and into the hopper, and a drive operatively connected to the screw for turning the screw in a direction in which the flight would, but for downward forces, lift the fuel. The heater also has a vane rotatably attached to the screw. The vane rotates downward along the screw in absence of upward forces counteracting gravity. The vane is cambered to produce upward forces when turning with the screw beneath an upper surface of the fuel. The vane is biased toward the upper surface of the fuel by the upward forces and gravity to level the upper surface of the fuel and prevent the fuel from rat holing and arching.

In another aspect, the present invention includes a flowable material delivery system, comprising a hopper sized for holding a preselected amount of material and having an outlet at a lower end. Further, the heater includes a screw having a helical flight extending through the hopper, a drive operatively connected to the screw for turning the screw in a direction in which the flight would, but for downward forces, lift the material, and a vane rotatably attached to the screw. The vane rotates downward along the screw in absence of upward forces counteracting gravity. The vane is cambered to produce upward forces when turning with the screw beneath an upper surface of the material. The vane is biased toward the upper surface of the material by the upward forces and gravity to level the upper surface of the material and prevent the material from rat holing and arching in the hopper.

In still another aspect, the present invention includes a heater, comprising a combustion chamber for burning fuel. The combustion chamber has an interior defined by side walls and a top. The combustion chamber includes an air inlet at a bottom of the combustion chamber and an exhaust vent at the top of the combustion chamber. The heater includes a fuel delivery system mounted above the combustion chamber for delivering fuel to the combustion chamber, a primary heat exchanger surrounding the combustion chamber for heating fluid passing through the primary heat exchanger, and a secondary heat exchanger surrounding a vent passage extending from the exhaust vent for heating fluid passing through the secondary heat exchanger. At least one of the primary and secondary heat exchangers is packed in sand to moderate heat passing to the exchanger.

Other aspects of the present invention will be apparent in view of the following description and claims.

BRIEF DESCRIPTION OF THE DRAWINGS

Corresponding reference characters indicate corresponding parts throughout the drawings.

DETAILED DESCRIPTION OF THE DRAWINGS

Figure 1:
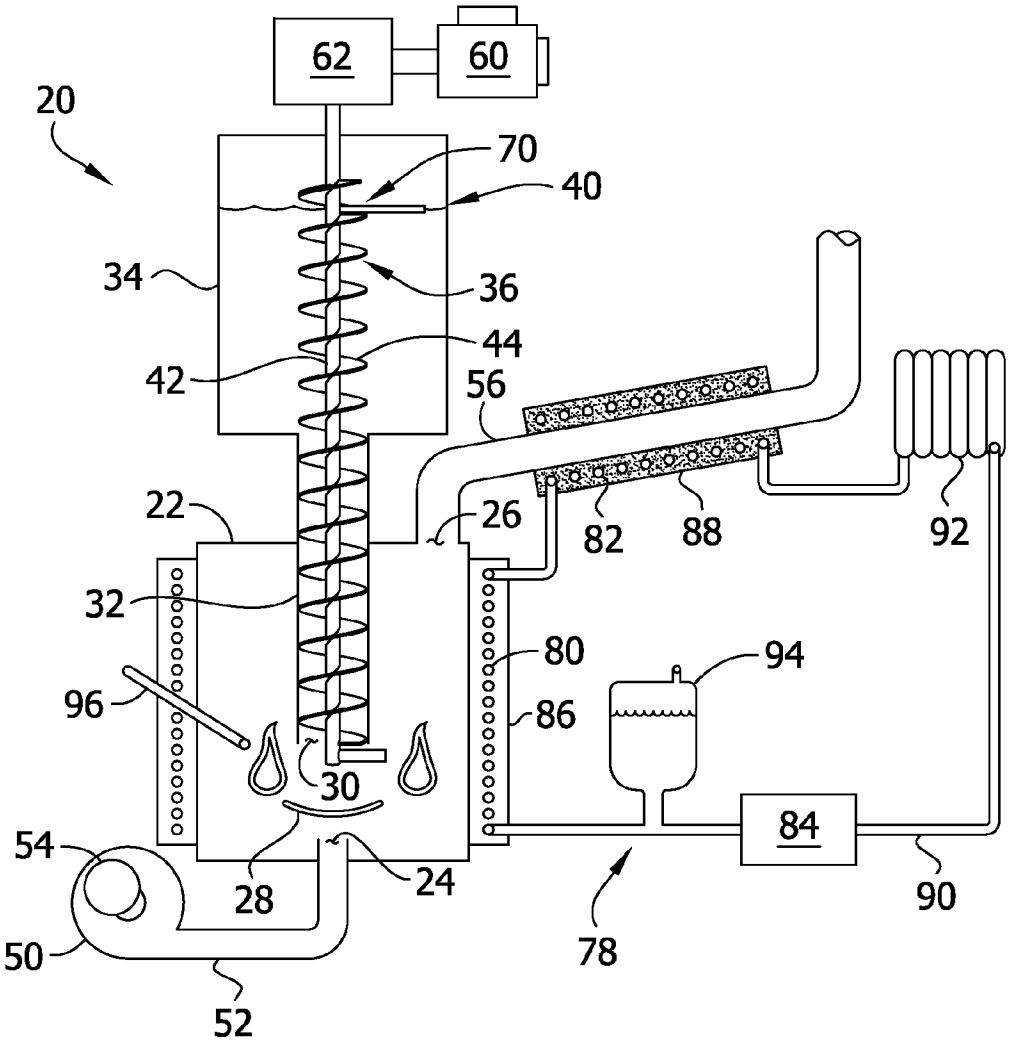
FIG. 1 is a schematic elevation of a heater system.

Referring to FIG. 1, a heater system incorporating a first embodiment of the present invention is designated in its entirety by the reference number 20. The heater 20 includes a combustion chamber or combustor 22 having an air inlet 24 entering an interior of the chamber through its bottom, and a vent 26 extending through a top of the chamber. An air deflector 28 is positioned immediately above the air inlet 24 and below a fuel inlet 30 through which fuel enters from a fuel delivery system, generally designated by 40. The fuel inlet 30 comprises a chute 32 mounted below a hopper 34. An auger, generally designated by 36, having a central shaft 42 and a helical flight 44 extends vertically through the hopper 34 and chute 32. Air entering through the air inlet 24 is deflected laterally by the deflector 28. Although the deflector 28 may have other shapes and configurations without departing from the scope of the present invention, in one embodiment the deflector is a spherically rounded steel plate having a downwardly facing convex face. A fan 50 is provided for blowing air through an inlet passage 52 to the air inlet 24. In one case, the fan 50 includes a damper 54 for adjusting an amount of air entering the combustion chamber 22. Although the fan may have other configurations without departing from the scope of the present invention, in one embodiment the fan is a conventional scroll or squirrel cage fan. The vent 26 is connected to a vent passage 56 extending away from the combustion chamber 22. Fuel such as wood chips or sawdust delivered through the chute 32 from the hopper 34 to the combustion chamber 22 is burned in the combustion chamber 22 in a ring extending around the deflector 28 between the deflector and chute 32. The burning fuel heats the combustion chamber 22 which radiates heat to its surrounding. Although the inlet passage 52 may be made from other materials without departing from the scope of the present invention, in one embodiment the passage is made from pipe or flexible tubing having a diameter of about two inches made from a material having a suitable temperature capability. Moreover, the inlet passage 52 of one embodiment is removable for maintenance and cleaning.

Figure 2:
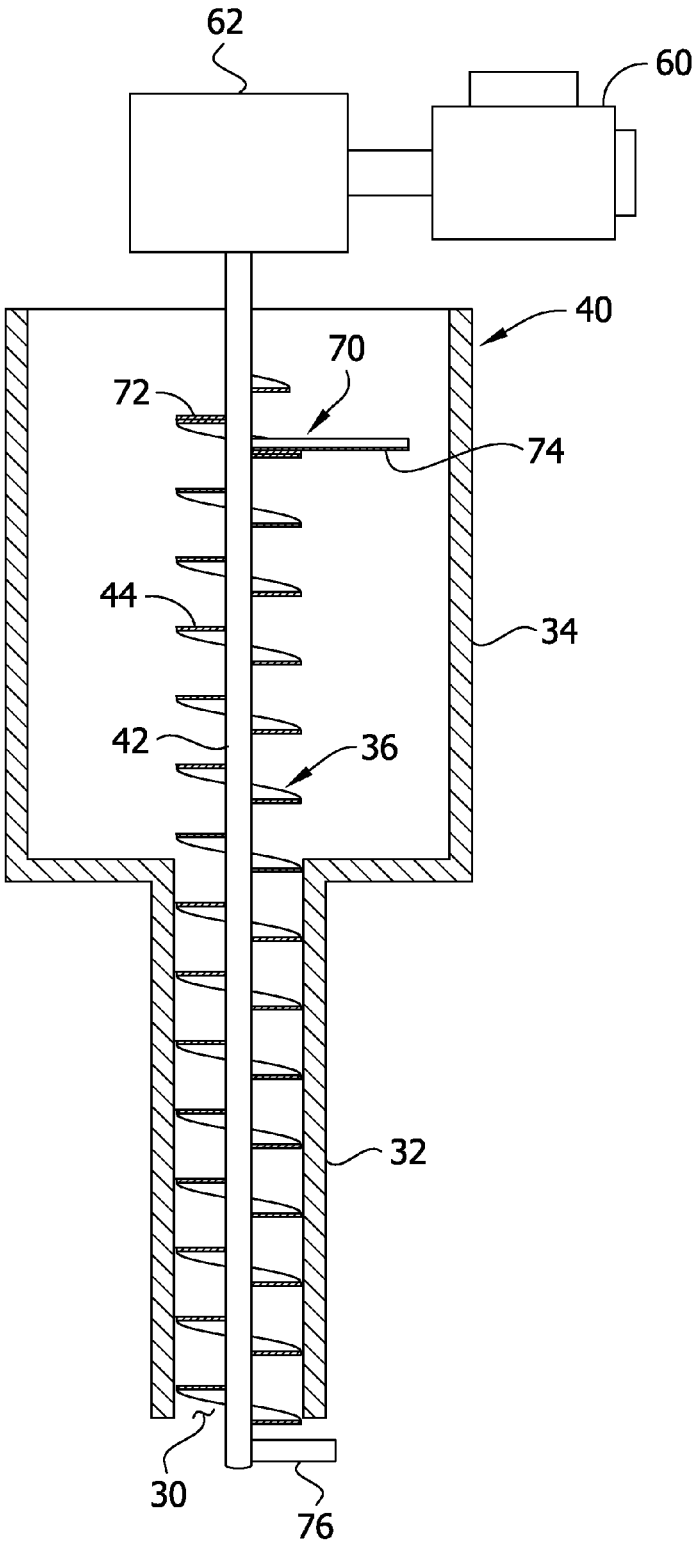
FIG. 2 is an elevation of a fuel delivery system of the heater system.
Figure 3:
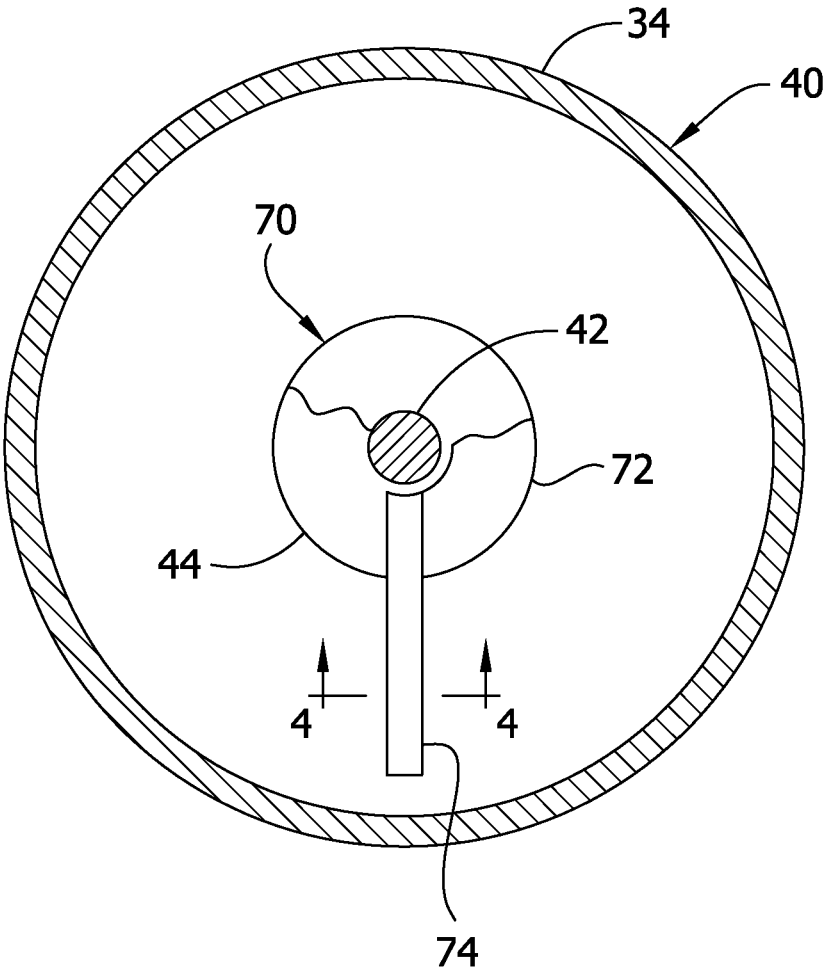
FIG. 3 is a top plan of the fuel delivery system.

As illustrated in FIGS. 2 and 3, the fuel delivery system 40 comprises a hopper 34 having a flat or sloped bottom for holding a supply of fuel and a chute 32 extending downward from the hopper to the fuel inlet 30 for transporting fuel from the hopper to the combustor for burning. The screw or auger 36 extends vertically through the hopper 34 and chute 32. The auger 36 turns in a direction that would lift the fuel through the chute 32 and hopper 34 if not for the fuel being flowable and gravity overcoming the lifting force provided by the auger. In other words, if the screw 26 is a conventional right-handed screw, the screw turns clockwise when viewed from above, and if left-handed, counterclockwise. Although the chute 32 has a circular cross section in the illustration, it is envisioned that the chute may have other cross-sectional shapes, such as polygonal, more particularly a regular polygon shape, and still more particularly a square shape. A drive motor 60 is operationally connected to the screw 36 for turning the screw in the previously described direction. The motor 60 may be connected directly to the screw 36 or via a transmission 62 such as a chain or belt drive and/or a gearbox without departing from the scope of the present invention. Although the auger 36 and chute 32 may be made from other materials without departing from the scope of the present invention, in one case the auger is a conventional steel auger having a diameter of about four inches above the chute and between about two inches and about three inches within the chute. The chute 32 has an inner diameter of about six inches and is made from a material having a suitable temperature capability. It is envisioned that a height of the chute 32 may be adjusted to change a distance between the lower end of the chute and the deflector 28 to optimize a maximum volume of fuel delivered to the combustion chamber 22 for burning before the fuel pile backs up into the chute, reaches equilibrium, and stops growing. Further, it is envisioned that the chute 32 height may be adjusted so the distance is optimized for different fuel types. In addition, it is envisioned that conventional controls can be used in the fuel delivery system 40 to limit maximum fuel volume and other operating parameters.

Figure 4:
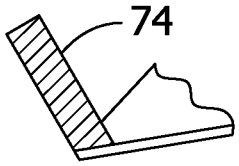
FIG. 4 is a cross section of a vane in the fuel delivery system.

A rake element, generally designated by 70, is mounted on the screw 36 in the hopper 34 for leveling fuel in the hopper to prevent rat holing and arching. Rat holing is a condition common in hoppers holding flowable solid materials in which a hole forms in the material above the hopper outlet but material clings to the hopper around the hole and does not fall through the outlet. Arching is another common condition similar to rat holing but where the hole formed in the material does not extend entirely upward through the material. Rather material bridges the hole over the hopper outlet. The rake element 70 includes a female-threaded connector 72 rotatably mounted on the screw 36 having a cambered vane 74 (FIG. 4) extending horizontally from the connector. The connector 72 illustrated in FIGS. 2 and 3 is formed from a shaftless auger flight threaded onto the auger 36 so the flight rests on the auger thread. As will be appreciated by those skilled in the art, when the rake element 70 is suspended above the fuel, the weight of the rake element causes it to spin downward along the auger 36 until the vane 74 rests on an upper surface of the fuel in the hopper 34. When resting on top of the fuel, the rake element turns with the auger 36 due to friction between the auger and connector 72 so the vane 74 floats on top of the fuel, levelling the upper surface of the fuel in the hopper 34 to prevent rat holing. When the rake element 70 is buried in the fuel below its upper surface, friction between the vane 74 and the auger 36 causes the vane to turn through the fuel. The vane 74 is cambered so it is lifted through the fuel as it turns with the auger 36 until the vane rises to the top of the fuel. As the vane 74 is lifted through the fuel, it agitates and churns the fuel to prevent arching. Although the vane 74 may be made of other materials, in one embodiment the vane is a steel bar welded to the connector 72. Further, the vane 74 has a length chosen to provide a suitable gap (e.g., 1½ inches) between the outer end of the vane and the inner surface of the hopper 34. A blade or wiper bar 76 is connected to a lower end of the auger 36 for clearing fuel that might otherwise block the fuel inlet 30. Although the hopper 34 may be made from other materials without departing from the scope of the present invention, in one embodiment the hopper is made from a steel barrel having an outside diameter of about fourteen inches.

The fuel delivery system 40 maintains a controlled and constant fuel flow through the chute 32 to the combustion chamber 22 during operation. It is believed that maintaining optimal fuel flow improves fuel burn and induces an appropriate draft in the combustion chamber 22, reducing heater smoking and soot buildup. Toward this end, the damper 54 position can be controlled during heater idling so the heater maintains a minimal burn so the fuel remains burning for an extended duration without adding more fuel. In one embodiment, the damper position can be controlled by a solenoid (not shown).

As will be appreciated by those skilled in the art, the fuel delivery system 40 operates to deliver fuel to the combustion chamber 22 from the hopper 36. The drive motor 60 rotates the auger 36 at a constant speed (e.g., about ten rpm), causing the rake element 70 to rotate around the auger and seek the top of the fuel in the hopper 36. The rake element 70 levels fuel in the hopper 36 and prevents rat holing and arching. The fuel falls through the chute 32, spiraling along the flight around the central shaft of the auger 36 under the influence of gravity. The fuel falls into the combustion chamber 22 and feeds the burning fuel in the vicinity of the deflector 28. Air blown through the air inlet 30 into combustor 22 passes around the deflector to feed air to the fire and improve fuel burn. Other aspects of the fuel delivery system will be apparent to those skilled in the art.

In addition to heating surrounding air by radiation, the heater 20 may include a heat extraction system, generally designated by 78, having one or more heat exchangers such as shown in FIG. 1 for heating fluid, e.g., water. In one embodiment, a first coiled tube 80 surrounds the combustion chamber 22 and a second coiled tube 82 surrounds the vent passage 56. Water is pumped by a conventional pump 84 through the coiled tubes 80, 82 to heat the water. In some cases, housings 86, 88 filled with sand surround the coiled tubes 80, 82, respectively. The sand in the housings 86, 88 retains heat to moderate heat input to water flowing through the coiled tubes 80, 82. Thus, the water temperature remains generally constant and does not fluctuate rapidly as conditions in the combustion chamber 22 change. In one example, the water travels via a water line 90 in a circuit, first through the coiled tube 80 surrounding the combustor 22 before traveling through the coiled tube 82 surrounding the vent passage 56. In some heat extraction systems, the heated water is used as a hot water source or to supplement a hot water system. The heated water may also pass through a remote heat exchanger 92 to warm air passing through the heat exchanger in a residence, office, or other space. Although the coiled tubes 80, 82 may be made from other materials without departing from the scope of the present invention, in one case the tubes are made from conventional flexible plastic tubing having a diameter of about inch. The housing 88 surrounding the vent passage 56 may be made of steel sheet and the housing 86 surrounding the combustor 22 may be formed from a steel drum having a diameter of about sixteen inches lined with a steel cylinder having a diameter of about fourteen inches. In this case the steel cylinder has a larger diameter than the combustion chamber 22, creating an air gap (e.g., a 4 inch gap) between the combustion chamber and the cylinder to insulate the coiled tube 80 from heat.

In the illustrated case, an accumulator or hot water tank 94 is positioned along the water line 90. The accumulator 94 stores heated water ensuring water continuously flows through the water line 90. Ensuring continuous flow provides a constant supply to the remote heat exchanger 92 and prevents the coiled tubes 80, 82 from overheating. As will be appreciated by those skilled in the art, the accumulator 94 is positioned higher than the rest of the water loop and is vented to eliminate gas from the loop.

In an alternative embodiment of the heat extraction system (not shown), the water loop may be replaced with a forced air system by blowing air through the housings 86, 88 to heat the air directly. The sand is removed from the housings 86, 88 in this alternative forced air embodiment. Duct work (not shown) is used to transport the heated air to the locale where it is needed.

In one case, a pyrometer 96 is provided in the combustion chamber 22 for measuring temperature of the fire in the combustion chamber. The pyrometer 96 confirms that the fuel is burning and can be operatively connected to a control for controlling operation of the heater. For example, if the pyrometer 94 determines the flame has gone out, the motor can be stopped to reduce an amount of fuel entering the combustion chamber 22.

Having described the invention in detail, it will be apparent that modifications and variations are possible without departing from the scope of the invention defined in the appended claims.

When introducing elements of the present invention or the preferred embodiment(s) thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A heater, comprising:

a combustion chamber for burning fuel, the combustion chamber having an interior defined by side walls and a top, the combustion chamber including an air inlet at a bottom of the combustion chamber and an exhaust vent at the top of the combustion chamber;

a hopper mounted above the combustion chamber, the hopper being sized for holding a preselected amount of fuel and having an outlet at a lower end;

a chute extending from the outlet of the hopper to the combustion chamber;

a screw having a helical flight extending through the chute and into the hopper;

a drive operatively connected to the screw, said drive turning the screw in a direction in which the flight would, but for downward forces, lift the fuel; and a vane connected directly to a helical connector that is separate from the screw and rests directly on the helical flight of the screw, said connector rotating downward relative to the screw along the flight of the screw in absence of upward forces counteracting gravity, said vane being cambered to produce upward forces when turning with the screw beneath an upper surface of the fuel, the helical flight of the screw and the helical connector are configured so that said vane is biased upward by said upward forces generated by the vane interacting with the fuel and said vane is biased downward by gravity acting on the vane and helical connector so that the upward force and gravity balance when the drive turns the screw at a preselected speed and the vane is at the upper surface of the fuel to level the upper surface of the fuel and prevent the fuel from rat holing and arching.

2. A heater as set forth in claim 1, further comprising a primary heat exchanger surrounding the combustion chamber for heating fluid passing through the primary heat exchanger.

3. A heater as set forth in claim 2, further comprising a secondary heat exchanger surrounding a vent passage extending from the exhaust vent for heating fluid passing through the secondary heat exchanger.

4. A heater as set forth in claim 3, further comprising a pump operatively connected to the primary heat exchanger and secondary heat exchanger for pumping fluid through said primary and secondary heat exchangers.

5. A heater as set forth in claim 4, further comprising a remote heat exchanger operatively connected to the primary heat exchanger and secondary heat exchanger for extracting heat from the fluid at a location spaced from the primary and secondary heat exchangers.

6. A heater as set forth in claim 4, wherein at least one of said primary and secondary heat exchangers is packed in sand to moderate heat passing to said exchanger.

7. A heater as set forth in claim 1, wherein said drive comprises a motor operatively connected to the screw.

8. A heater as set forth in claim 7, wherein a transmission connects the motor to the screw.

9. A heater as set forth in claim 1, further comprising a fan operatively connected to air inlet for blowing air into the combustion chamber.

10. A flowable material delivery system, comprising:

a hopper sized for holding a preselected amount of a predetermined flowable material and having an outlet at a lower end;

a screw having a helical flight extending through the hopper;

a drive operatively connected to the screw turning the screw in a direction in which the flight would, but for downward forces, lift the material; and a vane connected directly to a helical connector that is separate from the screw and rests directly on the helical flight of the screw, said connector rotating downward relative to the screw along the flight of the screw in absence of upward forces counteracting gravity, said vane being cambered to produce upward forces when turning with the screw beneath an upper surface of the material;

wherein the helical flight of the screw and the helical connector are configured so that said vane is biased upward by said upward forces generated by the vane interacting with the material and said vane is biased downward by gravity acting on the vane and helical connector so that the upward force and gravity balance when the drive turns the screw at a preselected speed and the vane is at the upper surface of the material to level the upper surface of the material and prevent the material from rat holing and arching in the hopper.

11. A flowable material delivery system as set forth in claim 10, wherein said vane extends laterally with respect to the screw.

12. A flowable material delivery system as set forth in claim 10, wherein said drive comprises a motor operatively connected to the screw.

13. A flowable material delivery system as set forth in claim 12, wherein a transmission connects the motor to the screw.

14. A flowable material delivery system, comprising:

a hopper sized for holding a preselected amount of a predetermined flowable material and having an outlet at a lower end;

a screw having a helical flight extending through the hopper;

a drive operatively connected to the screw turning the screw in a direction in which the flight would, but for downward forces, lift the material;

a vane connected directly to a helical connector resting directly on the helical flight of the screw, said connector rotating downward relative to the screw along the flight of the screw in absence of upward forces counteracting gravity, said vane being cambered to produce upward forces when turning with the screw beneath an upper surface of the material, the helical flight of the screw and the helical connector being configured so that said vane is biased upward by said upward forces generated by the vane interacting with the material and said vane is biased downward by gravity acting on the vane and helical connector so that the upward force and gravity balance when the drive turns the screw at a preselected speed and the vane is at the upper surface of the material to level the upper surface of the material and prevent the material from rat holing and arching in the hopper; and a combustion chamber mounted below the hopper for receiving material delivered from the hopper, said material being burned in the combustion chamber.

* * * * *